United States Patent [19]

Hussein

[11] Patent Number: 4,613,513

[45] Date of Patent: Sep. 23, 1986

[54] ESSENTIAL OILS TREATMENT TO REMOVE HARSH NOTES THEREFROM

[75] Inventor: Mamoun M. Hussein, Rye, N.Y.

[73] Assignee: Nabisco Brands, Inc., Parsippany, N.J.

[21] Appl. No.: 727,509

[22] Filed: Apr. 26, 1985

Related U.S. Application Data

[63] Continuation-in-part of Ser. No. 713,957, Mar. 20, 1985, abandoned.

[51] Int. Cl.[4] ..... C11B 9/00

[52] U.S. Cl. ..... 426/651; 426/424; 252/522 R

[58] Field of Search ..... 426/424, 651; 252/522 R

[56] References Cited

U.S. PATENT DOCUMENTS

| | | |
|---|---|---|
| 2,435,744 | 2/1948 | Hartman . |
| 2,712,008 | 6/1955 | Kirchner et al. . |
| 3,083,105 | 3/1963 | Todd . |
| 4,440,790 | 4/1984 | Blackwell et al. . |
| 4,456,621 | 6/1984 | Blackwell et al. . |
| 4,476,142 | 10/1984 | Netherwood et al. . |
| 4,478,864 | 10/1984 | Blackwell et al. . |

FOREIGN PATENT DOCUMENTS

| | | |
|---|---|---|
| 5642 | of 1927 | Australia . |
| 581189 | 8/1959 | Canada . |
| 2053641 | 7/1971 | France . |
| 036750 | 11/1970 | Japan . |
| 15320 | 5/1973 | Japan . |
| 151508 | 2/1981 | Japan . |
| 200321 | 1/1983 | Japan . |

OTHER PUBLICATIONS

R. H. Reitsema & F. J. Cramer, Oxidation of Peppermint Oil, Ind. Engr. Chem. vol. 44, #1, Jan. 1952, pp. 176–180.

R. H. Eastman; The Isolation of Menthofuran from American Peppermint Oil; Notes, J.A.C.S; Nov. 1950, pp. 5313–5314.

W. Wong, Thesis at the Graduate School of Rutgers–The State Univ. of NJ 1972, The Changes that Occur in Peppermint Oil During Aging, etc.; 72–27612, Univ. Microfilms, pp. ii to xv, and 91 to 116.

*Primary Examiner*—Joseph Golian

*Attorney, Agent, or Firm*—Richard Kornutik

[57] ABSTRACT

Essential oils extracted from botanical material are treated with Fehlings solution to remove harsh flavor off-notes therefrom.

5 Claims, No Drawings

ESSENTIAL OILS TREATMENT TO REMOVE HARSH NOTES THEREFROM

CROSS REFERENCE TO RELATED PATENT APPLICATION

This patent application is a continuation-in-part of application Ser. No. 713,957, filed Mar. 20, 1985 and now abandoned.

BACKGROUND OF THE INVENTION

1. Field of the Invention

The present invention relates to essential oils extracted from botanical matter which are treated with Fehlings solution to remove harsh flavor notes therefrom.

2. Description of the Prior Art

Essential oils which are freshly distilled from botanical matter ususally have, when freshly made, what are known as harsh tasting flavor notes. These harsh flavor off-notes are also known as green, burnt still off-notes. This is particularly true in the case of peppermint oil or spearmint oil which is freshly made by means of steam distillation of the parent botanical matter from which the oil is extracted. The customary procedure employed for removing those harsh flavor notes which are present in the freshly obtained oil is to allow the oil to age or mellow for periods of about 6 to 24 months, in full containers in the presence of oxygen and in the absence of actinic radiation. This aging-mellowing process is economically unattractive since it requires the use of carefully monitored storage facilities, for long periods of time and supervised by technically trained personnel. All of these storage requirements are economically burdensome.

U.S. Pat. No. 4,478,864 discloses the treatment of freshly prepared peppermint oil with maleic anhydride for the purposes of preventing the formation of certain off flavor notes during the aging process. This process removes most of the menthofuran from the fresh peppermint oil, in the form of a menthofuran-maleic anhydride complex. Thus, very little menthofuran is present, during the aging process, to oxidize to produce undesirable flavor notes. This process, however, does not cure all the off-flavor note problems inherent in fresh peppermint oil. An essential oil treated by the process of U.S. Pat. No. 4,478,864 may still have to undergo an aging process to remove off-flavor notes that are present in the freshly prepared oil.

Prior to the present invention, therefore, it has not been possible to treat freshly made essential oils in a facile manner so as to readily remove therefrom harsh flavor off-notes then present therein with a reagent that can be readily removed from the oil.

OBJECTS OF THE PRESENT INVENTION

An object of the present invention is to provide essential oils which are freshly extracted from botanical matter and which are rendered free of harsh flavor off-notes present in the fresh, unaged, oil.

A further object of the present invention is to provide a facile process for treating freshly extracted essential oils of botanical matter so as to readily render them free of harsh flavor off-notes then present therein.

Summary of the Present Invention

It has now been found according to the present invention that essential oils freshly extracted from botanical matter which then contain harsh flavor off-notes can be readily freed of such harsh flavor off-notes by treating the oil with Fehlings solution.

DESCRIPTION OF THE PREFERRED EMBODIMENT

Fehlings solution is an alkaline solution of copper hydroxide and sodium or potassium tartrate in sodium hydroxide. It is a mild oxidizing agent.

The essential oils which are to be treated with Fehlings solution in accordance with the present invention are the freshly extracted essential oils of botanical matter. These oils are used as flavorants in the food, confectionary, perfume and cosmetic industries. These oils would include those obtained from the following botanical materials: anise, basil, dill weed, chamomile, eucalyptus, fennel, geranium, hop, laurel leaf, lemongrass, bois de rose, caraway, amber, camphor, amyris, galbanum, davana, mentha (spearmint and peppermint).

The essential oils which are to be treated with the Fehlings solution in accordance with the present invention may be extracted from their parent botanical matter, ie, leaves, fruit, bark, root, grass, wood, heartwood, gum, balsam, berries, seed, flowers, twigs and buds, by the commonly employed technique for doing so, i.e., steam distillation.

The fresh oil may be rectified (redistilled) prior to or after treatment with the Fehlings solution to improve a particular property characteristic. For example, peppermint oil may be rectified to remove dimethyl sulfide therefrom which provides a green weedy note.

The harsh flavor off-notes in the fresh essential oils, which are to be removed by treatment with the Fehlings solution, may be characterized, as such, organoleptically. Organoleptically these harsh off-flavor notes may be characterized as: harsh, green, raw, weedy, skunky and burnt.

The chemical components of the fresh essential oils which are believed responsible for the harsh (tasting) flavor off-notes have not been determined analytically. They are present, at most, at trace concentrations in the oil. When the essential oils are analyzed by gas chromatography prior to and after the treatment of the present invention, no apparent changes in the composition of the volatile components of the oil can be detected (analytically). By volatile components it is meant those components of the oil which are volatile enough as to be capable of being detected by gas chromatography analysis using a Carbowax-20M column operated at a maximum temperature of 230° C. and with an injector temperature of a maximum of 250° C.

In treating the essential oil with the Fehlings solution according to the present invention the oil may be extracted in a liquid/liquid extraction with the Fehlings solution, or it may be contacted with the Fehling's solution immobilized on a solid support. The Fehling's solution is used freshly prepared.

At least 1%, and preferably about 2 to 5%, by volume of the Fehlings solution is used per liter (1000 ml) of the oil to be treated. The treatment may be conducted at room temperature, of about 20–25° C., although at higher temperatures a more rapid/efficient extraction may be effected. The liquid/liquid extraction may be done by shaking a mixture of the oil and the Fehlings solution in commonly employed shaking devices designed to effect efficient liquid/liquid extraction systems. Depending on the amount of Fehlings solution used, the size of the oil sample being extracted, and the amount of harsh flavor off-notes initially present in such sample, and the shaking device employed, the extraction time required may be about one to ten minutes.

Only one treatment of the oil with the Fehlings solution is needed in order to adequately accomplish the removal of the harsh flavor off-notes. With such a treatment all of the harsh flavor notes are readily removed.

After the aqueous Fehlings solution is used to treat the essential oil in the liquid/liquid extraction process, it is readily removed therefrom by the use of oil/water separating devices such as a separatory funnel, with or without prior centrifuging. Residual traces of the Fehlings solution can be further readily extracted from the oil by treatment with a solution of NaCl followed by washing with distilled water. The oil is then dried by high speed centrifugation.

Contrary to the teachings of U.S. Pat. No. 4,478,864, whereby the agent which would cause the creation of the off flavor note (upon aging in the oil) is actually removed from the fresh oil as a menthofuran-maleic anhydride complex, the agent(s) which are causing the off-flavor notes in the fresh oil, and which are treated with the Fehlings solution according to the present invention, are not removed from the fresh oil by such treatment. The Fehlings solution presumably oxidizes the agents causing the off-flavor notes in such a way as to then render them innocuous from an off-flavor point of view. Thus, it is not necessary to further age the fresh oil, as is otherwise commonly done, to accomplish the same result.

The treatment of the fresh essential oil with the Fehlings solution can be accomplished before or after any treatment of the oil according to the process of U.S. Pat. No. 4,478,864.

The various types of products into which the essential oils of the present invention may be added as flavors or fragrances would include food, confectionary, including chewing gum and pressed mints, perfumes, cosmetic and body hygiene products.

The following examples are merely illustrative of the scope of the present invention and are not intended as a limitation upon the scope thereof.

EXAMPLE 1

A 100 ml sample of freshly distilled peppermint oil was shaken, in a 250 ml separatory funnel, with 1 ml each of 0.43 M $CuSO_4$ solution (Fehling A solution) and 1.64M alkaline Rochelle salt solution (Fehling B solution) for 1 to 2 minutes. The aqueous (bottom) layer was discarded after complete separation of the layers. The peppermint oil layer was washed by extraction with $2\times50$ ml 10% NaCl solution and $2\times50$ ml distilled water, and the completely separated aqueous layer was then discarded. The oil was dried with 4 g anhydrous sodium sulfate and by centrifugation at 2000 to 3000 rpm.

The resulting oil is crystal clear and possesses a clean characteristic mellow aroma of a good quality aged peppermint oil. The harsh objectionable aroma of the starting oil is eliminated. The taste of the treated oil, when evaluated in a sugar fondant at 0.2 weight percent level and in a chewing gum at about 0.5 to 1.5 weight percent level, was similarly improved from that of the starting oil.

EXAMPLE 2

A sample of freshly distilled spearmint oil was also treated according to the procedure of Example 1. A similar improvement of the treated oil was noted.

The magnitude of improvement in a treated oil depends on the quality of the starting oil; the more objectionable and the harsher the starting oil is, the more dramatic is the improvement obtained by the treatment thereof according to the present invention.

What is claimed is:

1. A process for the removal of harsh flavor off-notes from the distilled essential oil of a botanical material selected from mentha which comprises contacting said oil with Fehlings solution in such amounts as to effect such removal and separating the Fehlings solution from the essential oil.

2. A process as in claim 1 in which said essential oil is a mint oil.

3. A process as in claim 1 in which said essential oil is peppermint oil.

4. A process as in claim 1 in which said essential oil is spearmint oil.

5. A process as in claim 1 in which said essential oil is treated with 1 to about 5% by volume of said Fehling's solution at room temperature.

* * * * *